US006064048A

United States Patent [19]

Lim

[11] Patent Number: 6,064,048

[45] Date of Patent: May 16, 2000

[54] MAGNETRON DRIVING CONTROL APPARATUS OF MICROWAVE OVEN AND METHOD THEREOF

[75] Inventor: Dong-Bin Lim, Suwon, Rep. of Korea

[73] Assignee: Samsung Electronics Co., Ltd., Suwon, Rep. of Korea

[21] Appl. No.: 09/128,786

[22] Filed: Aug. 4, 1998

[30] Foreign Application Priority Data

Apr. 30, 1998 [KR] Rep. of Korea ..... 98-15635

[51] Int. Cl.[7] ..... H05B 6/68

[52] U.S. Cl. ..... 219/716; 219/702; 219/718

[58] Field of Search ..... 219/715, 716, 219/718, 702, 703

[56] References Cited

U.S. PATENT DOCUMENTS

| | | | |
|---|---|---|---|
| 4,453,066 | 6/1984 | Mori | 219/703 |
| 4,506,127 | 3/1985 | Satoh | 219/710 |
| 4,724,291 | 2/1988 | Inumada | 219/718 |
| 4,777,575 | 10/1988 | Yamato et al. | 363/21 |
| 4,900,885 | 2/1990 | Inumada | 219/716 |
| 5,548,103 | 8/1996 | Morita | 219/703 |

*Primary Examiner*—Philip H. Leung
*Attorney, Agent, or Firm*—Burns, Doane, Swecker & Mathis, L.L.P.

[57] ABSTRACT

A magnetron driving control apparatus of a microwave oven and a method thereof by which a magnetron is continuously driven when an output level selectively input by a user belongs to a continuous driving output range, and when the output level exceeds an established time, the magnetron is intermittently driven according to a predetermined period to allow a high voltage transformer to cool by itself during the period the driving of the magnetron is stopped, thereby preventing the high voltage transformer from becoming over-heated and avoiding the high voltage transformer from becoming larger in size to decrease a heat generated by an electric resistance.

5 Claims, 8 Drawing Sheets

MAGNETRON DRIVING CONTROL APPARATUS OF MICROWAVE OVEN AND METHOD THEREOF

BACKGROUND OF THE INVENTION

1. Field of the Invention

The present invention relates to a microwave oven, and more particularly to a magnetron driving control apparatus of a microwave oven and method thereof by which a magnetron is controllably driven to prevent a high voltage transformer from being over-heated without recourse to a large-sized high voltage transformer for decreasing a heat generation caused by electrical resistance.

2. Description of the Prior Art

Generally, a microwave oven is a cooking device for cooking foodstuff by way of dielectric heating of microwaves.

The microwave oven thus described includes, as illustrated in FIG. 1, a high voltage transformer 10, a magnetron 20, a waveguide 30, a cooking chamber 40, a turntable 50, a turntable motor 60, a fan 70 and a fan motor 80.

The high voltage transformer 10, in FIG. 1, converts a commercial alternating current AC voltage input from outside to a high voltage (by way of example, 2KV) appropriate enough to generate a high frequency wave, thereby applying same to the magnetron 20, where the magnetron 20 performs a high frequency wave oscillation according to the high voltage input from the high voltage transformer 10 to generate a microwave. The waveguide 30 serves to guide the microwave generated from the magnetron 20 into the cooking chamber 40.

The turntable motor 60 is operated at a low speed (by way of example, 10 rpm) by a predetermined level of voltage applied from electric power source means (not shown) to rotate the turntable 50, which is cooperatively rotated with the turntable motor 60 to evenly radiate the microwave on the foodstuff placed thereon.

Furthermore, the fan motor 80 is driven by the commercial AC voltage input from outside to rotate the fan 70. The fan 70 is cooperatively rotated with the fan motor 80 to cool the high temperature heat generated from the magnetron 20 when the magnetron 20 is rotated and to blow cool air of outside to the magnetron 20.

Operational process of the microwave oven thus constructed according to the prior art is described below.

First of all, when a cooking time set-up key at a key input unit is manipulated to input a cooking time and an output control key is manipulated to set up power output level, and a cooking start/stop selection key is manipulated to instruct a cooking start, a key signal corresponding thereto is applied to a control unit from the key input unit.

At this time, the control unit discriminates the cooking time and the output level set up by a user according to the key signal input from the key input unit and when the key signal is input from the key input unit to instruct the cooking commencement, the turntable motor 60 and the fan motor 80 are driven to rotate the turntable 50 and the fan 70.

When the output level established by the user is discriminated as a maximum value, the control unit continuously supplies to the magnetron 20 the high voltage generated from the high voltage transformer 10 during a cooking time established by the user.

At this time, microwaves are continuously generated from the magnetron 20 according to the high voltage continuously supplied from the high voltage transformer 10 to be supplied into the cooking chamber 40 via the waveguide 30, thereby cooking the foodstuff placed on the turntable 50 by way of dielectric heating action.

Meanwhile, when the output level established by the user is less than the maximum value (by way of example, 10–90%, in case of the maximum value of the output level being at 100%), the control unit supplies to the magnetron 20 in an off-and-on way the high voltage generated from the high voltage transformer 10 according to on/off period corresponding to the output level established by the user.

The microwaves are generated in an off-and-on way according to the high voltage intermittently supplied from the high voltage transformer 10 to be supplied into the cooking chamber 40 through the waveguide 30, such that the foodstuff on the turntable 50 is cooked by way of dielectric heating operation.

In other words, when the output level set up by the user is at the maximum value, the magnetron 20 is continuously activated, and when the output level established by the user is at less than the maximum value, the magnetron 20 is intermittently driven according to driving period corresponding thereto to thereby control an output of the microwaves.

Meanwhile, an mentioned above, when the magnetron 20 is intermittently driven according to the output level established at less than the maximum value, the high voltage transformer 10 is naturally cooled during the on/off period to thereby generate a small quantity of heat. However, when the magnetron 20 is continuously driven according to the output level established at the maximum value, a relative oven-heat is generated because there is no time for the high voltage transformer 10 to cool by itself.

At this time, according as coil temperature at the high voltage transformer 10 becomes higher, coil resistance is increased to make copper loss bigger, such that, when the high voltage transformer is over-heated by the continuous driving of the magnetron 20 as described above, the high voltage transformer 10 is deteriorated in efficiency thereof to increase a power loss and to occasionally cause a fire due to the over-heat.

Accordingly, International Electrotechnical Commission IEC has stipulated that a high voltage transformer shall not exceed a regulated temperature, such that a large-sized high voltage transformer which has enlarged the sizes of the coil diameter and core has been installed in the microwave oven according to the prior art to meet the regulations of IEC.

By way of reference, when the sizes of the coil diameter and core become larger, electric resistance becomes small to decrease a heat generation according to the resistance and subsequently to decrease the whole heat generation.

However, there is a problem in the microwave oven according to the prior art thus described in that a large sized high voltage transformer having enlarged coil diameter and core is mounted therein to meet the temperature stipulated by IEC, to thereby increase a manufacturing cost and overall weight of the product.

SUMMARY OF THE INVENTION

The present invention is disclosed to solve the aforementioned problems and it is an object of the present invention to provide a magnetron driving control apparatus of a microwave oven and a method thereby by which a magnetron is continuously driven when an output level selectively input by a user belongs to a continuous driving output range, and when the output level exceeds an established time, the magnetron is intermittently driven according to a predetermined period to allow a high voltage transformer to cool by itself during the period the driving of the magnetron is stopped, thereby preventing the high voltage transformer from becoming over-heated and avoiding the high voltage transformer from becoming larger in size to decrease a heat generated by an electric resistance.

In accordance with one object of the present invention there is provided a magnetron driving control apparatus of a microwave oven, the apparatus comprising:

comparing means for comparing an output level selectively input by a user with a pre-established continuous driving output range; and driving means for intermittently driving a magnetron according to a period corresponding to the selectively input output level when the selectively input output level does not belong to the continuous driving output range as a result of comparative result obtained by the comparing means, and for continuously driving the magnetron when the selectively input output level belongs to the continuous driving output range and for intermittently driving the magnetron according to a predetermined period when a predetermined established time is exceeded.

In accordance with another object of the present invention, there is provided a magnetron driving control method of a microwave oven, the method comprising the steps of:

comparing an output level selectively input by a user with a pre-established continuous driving output range; and intermittently driving a magnetron according to a period corresponding to the selectively input output level when the selectively input output level does not belong to the continuous driving output range as a result of comparative result obtained at the comparing step, and for continuously driving the magnetron when the selectively input output level belongs to the continuous driving output range and for intermittently driving the magnetron according to a predetermined period when a predetermined established time is exceeded.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Preferred embodiments of the present invention will now be described in detail with reference to the accompanying drawings.

Figure 1:
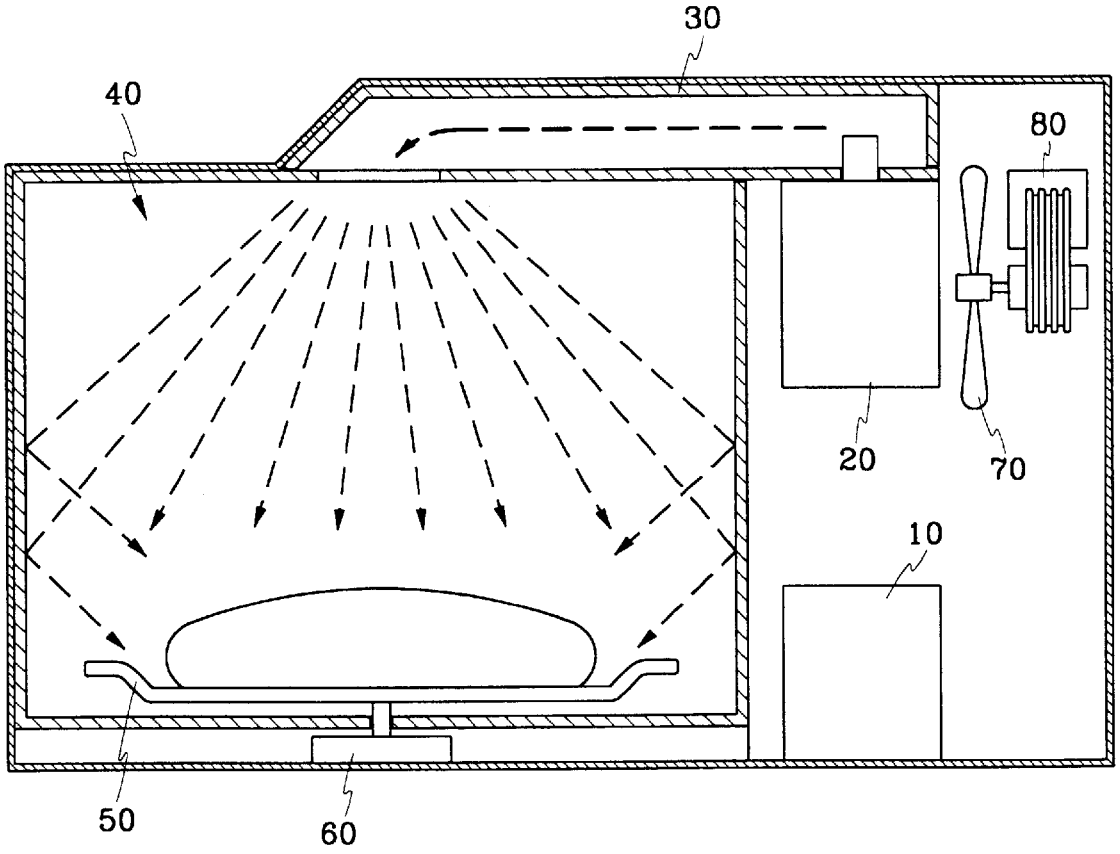
FIG. 1 (PRIOR ART)
FIG. 1 is a schematic diagram for illustrating an inner structure of an microwave oven according to the prior art.

The magnetron driving apparatus of a microwave oven according to the preferred embodiments of the present invention includes a key input unit 110, a control unit 120, a magnetron driver 130, a turntable driver 140, a fan driver 150 and a signal sound generator 160, and fundamental construction of hardware in the preferred embodiments is the same as that of the inner structure of a microwave oven illustrated in FIG. 1, so that like reference numerals and symbols are designation of like or equivalent parts or portions and redundant reference will be omitted for simplicity of illustration and explanation.

Figure 2:
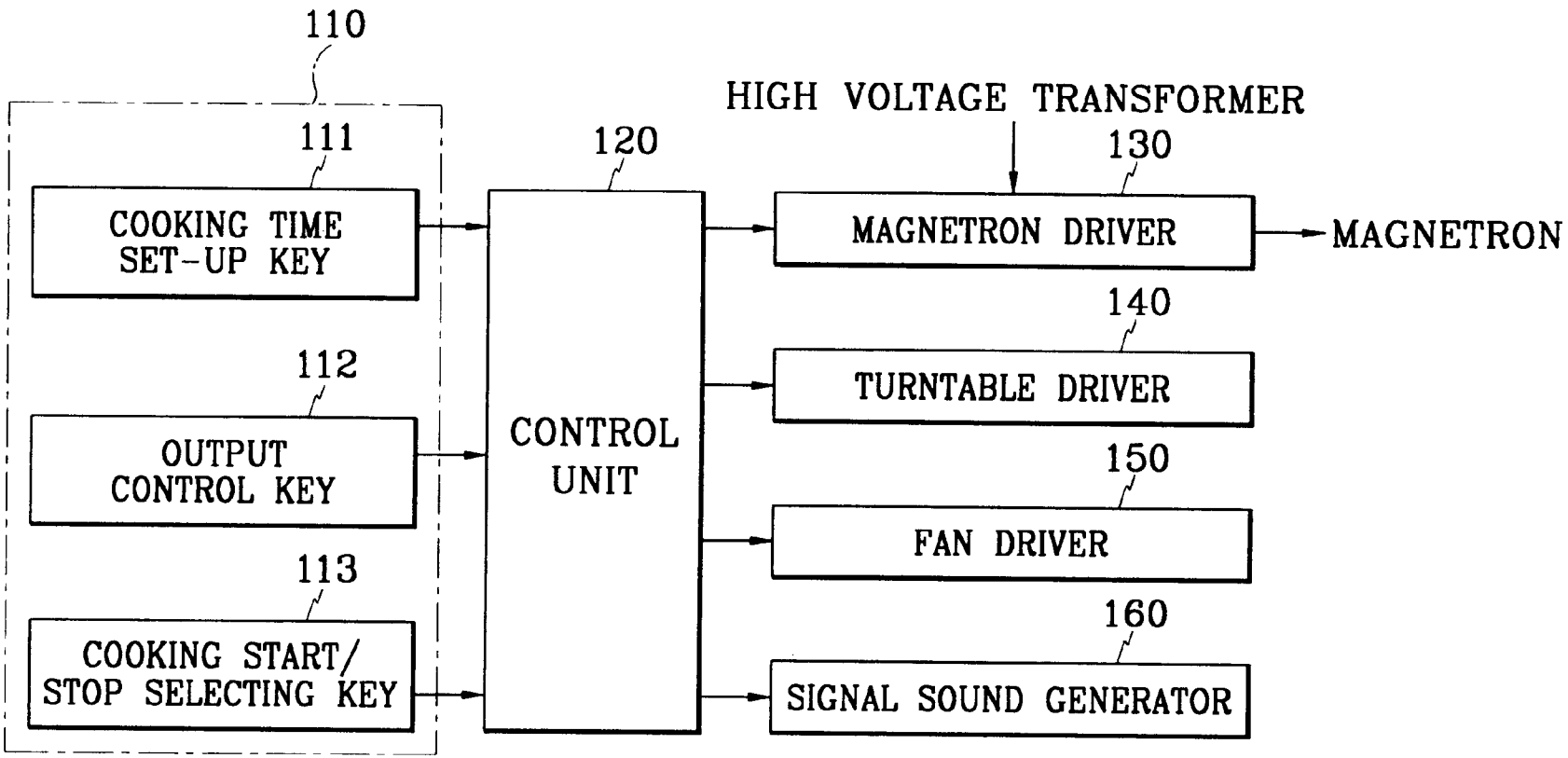
FIG. 2 is a schematic block diagram for illustrating a magnetron driving control apparatus of a microwave oven according to a first embodiment of the present invention.

The key input unit 110 in FIG. 2 includes a cooking time setup key 111 for inputting a cooking time (TS), an output control key 112 for inputting an output level and a cooking start/stop selecting key 113 for instructing a cooking start and a cooking stop.

When a key is manipulated by a user, a key signal corresponding to each key thus manipulated is input to the control unit 120.

The control unit 120 discriminates the cooking time (TS) and the output level established by the user according to the key signal input from the key input unit 110, and outputs respective control signals for controlling the magnetron driver 130, the turntable driver 140 and the fan driver 150 according to the cooking time (TS) and output level thus discriminated when a key signal for instructing the cooking start is input, and outputs a control signal for generating a cooking completion sound when the cooking is completed.

Furthermore, the magnetron driver 130 supplies to the magnetron 20 a high voltage changed in voltage via the high voltage transformer 10 according to the control signal output from the control unit 120, and the turntable driver 140 serves to drive the turntable 60 according to the control signal output from the control unit 120.

The fan driver 150 drives the fan motor 80 according to the control signal from the control unit 120 and the signal sound generator 160 generates a cooking completion sound according to the control signal supplied from the control unit 120.

Figure 3:
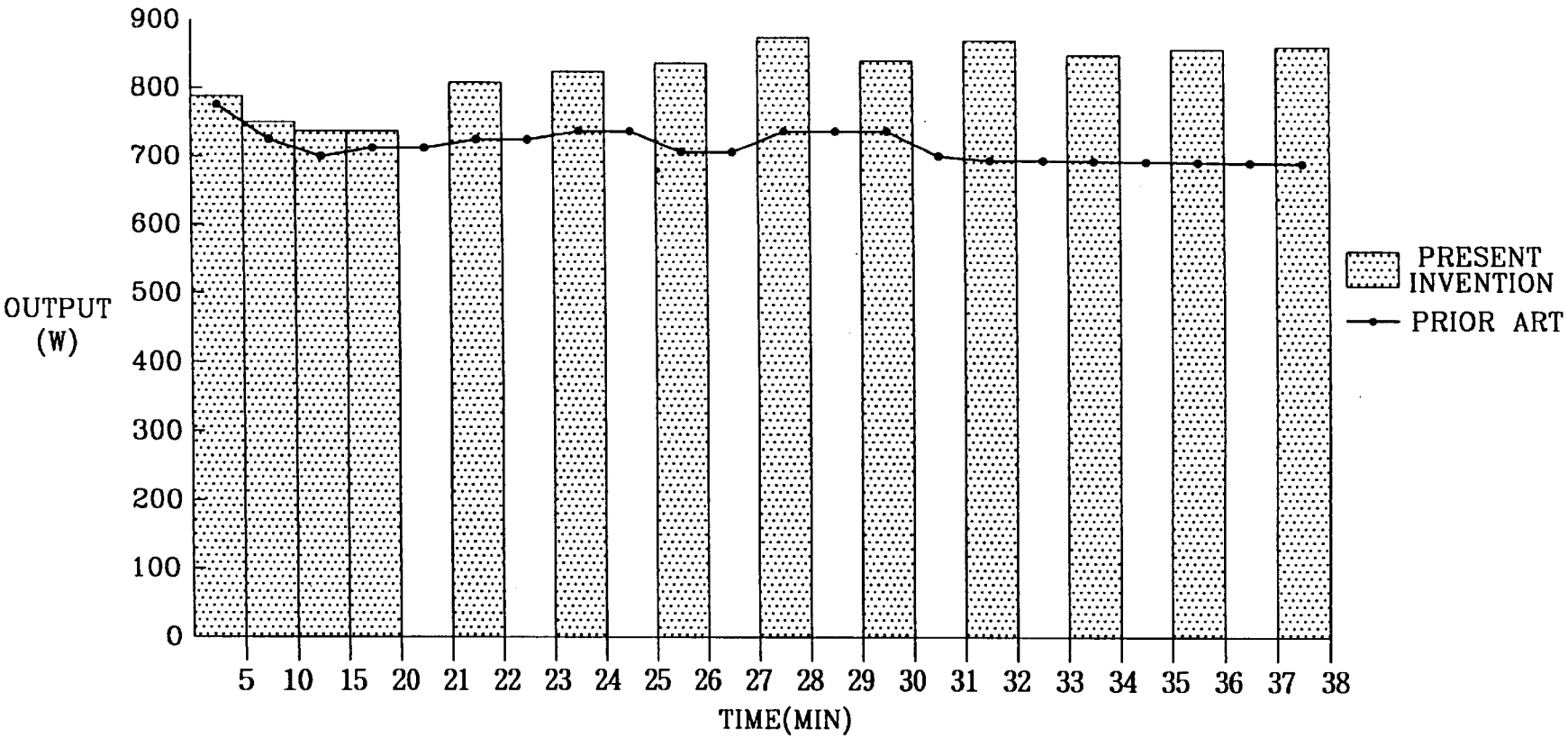
FIG. 3 is a graph for illustrating one example of output status in a high voltage transformer according to the first embodiment of the present invention.

FIG. 3 is a graph for illustrating an output status of the high voltage transformer 10 when the magnetron 20 is continuously driven for approximately 15 minutes and then driven approximately for every one minute, where heat is reduced in generation thereof as the high voltage transformer 10 is cooled by itself during a period driving is stopped while the magnetron 20 is intermittently driven, to thereby decrease the copper loss, so that output of the high voltage transformer 10 is increased compared with that of the prior art.

Figure 4:
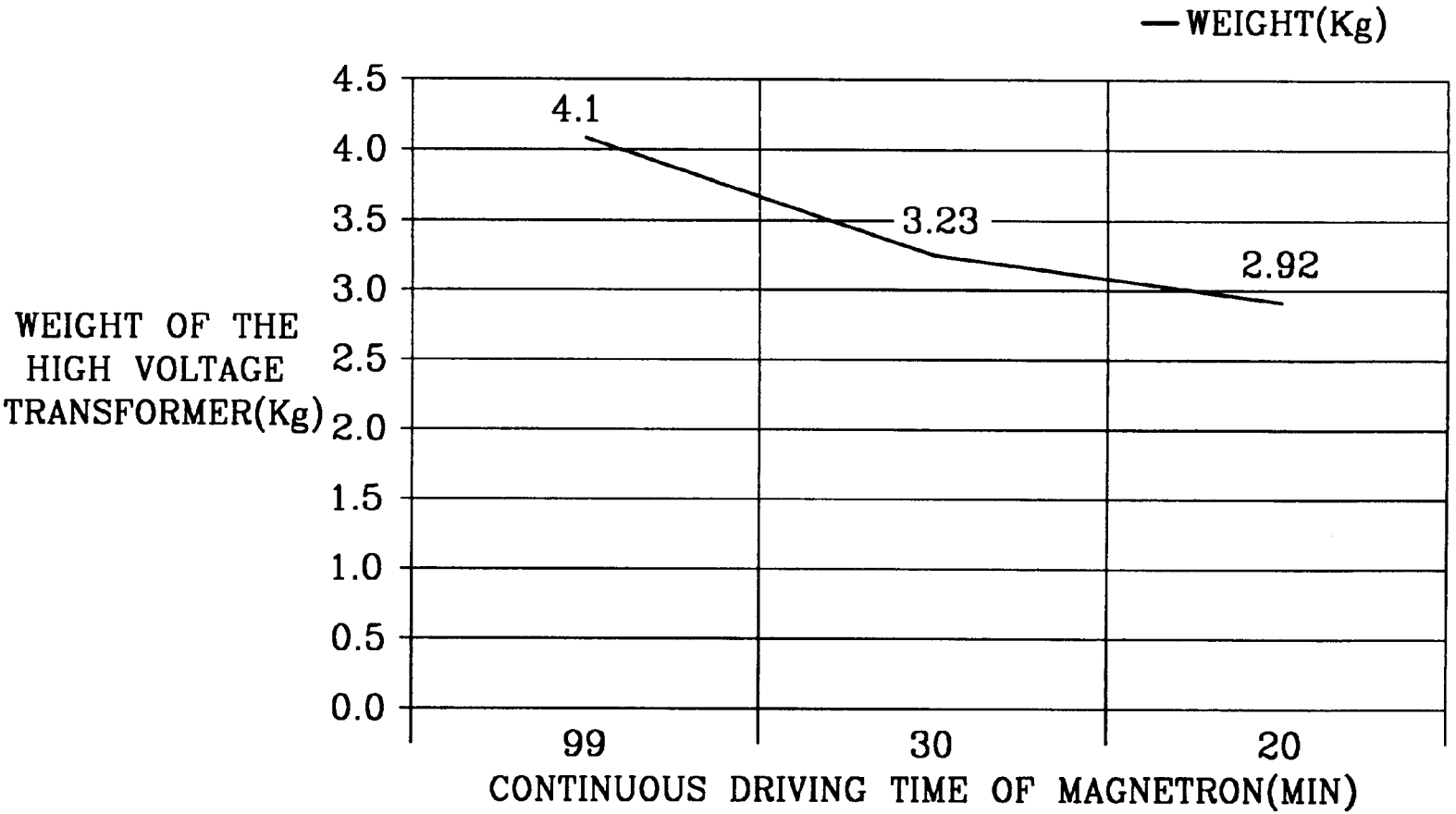
FIG. 4 is a graph for illustrating a correlation between a continuous operating time of a magnetron and a weight of a high voltage transformer.

FIG. 4 is a graph for illustrating a correlation between a continuous operating time of a magnetron and weight of a high voltage transformer, where it can be noted that the weight of the high voltage transformer 10 becomes decreased as the continuous operating time of the magnetron 20 is shortened.

Now, operational procedures of the present invention thus constructed will be described in detail with reference to FIGS. 2, 3, 4 and 5, where S denotes steps.

First of all, when a commercial AC voltage is supplied to the microwave oven from outside, the control unit 120 is initialized, step S10.

At this time, when the user manipulates a cooking time step-up key 111 at the key input unit 110 to selectively input a cooking time and then operates an output control key 112 to selectively input an output level, a key signal corresponding thereto is input to the control unit 120 from the key input unit 110, where the control unit 120 discriminates the cooking time (TS) selectively input by the user and the output level via the key signal input from the key input unit 110, step S20.

Successively, the control unit 120 repeatedly discriminates whether a key signal for instructing the cooking start has been input from the key input unit 110, step S30, and when the key signal is input from the key input unit 110, the control unit 120 outputs a control signal for driving the turntable 50 and the fan 70, step S40.

The turntable driver 150 serves to rotate the turntable 50 at a slow speed and to drive the fan motor 80 and to cooperatively rotate the fan 70.

Successively, the control unit 120 discriminates whether the output level selectively input via the key input unit 110 at step S20 is at a maximum value, step S50, and if the output level selectively input is at less than the maximum value (by way of example, 90–100%), the magnetron 20 is intermittently driven during the cooking time (TS) selectively input via the key input unit 110 according to the ON/OFF period corresponding to the output level selectively input through the key input unit 110, and operational procedures thereto will be omitted as they are the same as those of the prior art.

Meanwhile, as a result of discrimination at step S50, if the output level selectively input through the key input unit 100 is at the maximum value, the control unit 120 applies a control signal to the magnetron driver 130 to continuously drive the magnetron 20, step S70.

Successively, the high voltage transformed from the high voltage transformer 10 by the control signal output from the control unit 120 is continuously supplied to the magnetron 20 via the magnetron driver 130 to thereby generate microwaves continuously. The microwaves are supplied into the cooking chamber 40 via the wave guide to cook the foodstuff on the turntable 50 by way of dielectric heating operation thereof.

At this time, the control unit 120 counts the time from which the magnetron at step S70 is driven, step S80, compares the counted time with the cooking time (TS) selectively input, step S90, and if the counted time is beyond the cooking time (TS), flow proceeds to a subsequent step S150 to stop the magnetron 20.

As a result of the comparative result at step S90, if the counted time is less than the cooking time (TS), the control unit 120 discriminates whether the counted time is beyond the pre-established driving limit time (TL; by way of example, approximately 30 minutes), step S100, and if the counted time is within the driving limit time (TL), flow returns to step S70 to maintain a continuous driving status of the magnetron 20.

At this time, the driving limit time (TL) is established in consideration of size and weight of the high voltage transformer 10, and correlation between the continuous driving time of the magnetron 20 and the weight of the high voltage transformer 20 is shown on FIG. 4.

As a result of the discrimination at step S100, if the counted time exceeds the pre-established driving limit time (TL), the control unit 120 supplies a control signal to the magnetron driver 130 to intermittently drive the magnetron 20 according to a predetermined period (by way of example, approximately one minute), step S 110.

Successively, the high voltage of the high voltage transformer 10 is intermittently supplied to the magnetron 20 via the magnetron driver 130 according to the control signal output from the control unit 120, and microwaves are intermittently generated from the magnetron 20 to be supplied to an interior of the cooking chamber 40 via the waveguide 30.

At this time, the high heat generated from the high voltage transformer 10 is cooled by a natural convection of ambient air at an OFF period during which current does not flow from the high voltage transformer 10 due to inactivation of the magnetron 20, thereby preventing the generation of high heat that exceeds a rated temperature.

Next, the control unit 120 checks a driving time of the magnetron 20 intermittently driven at step S110, in other words, checks the time of ON period excepting the OFF period, step S120, and calculates step S130, a total driving time of the magnetron 20 including the time at which the magnetron 20 is continuously operated at step S70.

Furthermore, a comparison is made, step S140 between the total driving time of the magnetron 20 calculated by the control unit 120 at step S130 and the selectively-input cooking time (TS), step S140, and as a result of the comparison, if the total driving time of the magnetron 20 is less than the cooking time (TS), flow returns to step S110 to maintain a periodic driving status of the magnetron 20.

As a result of the discrimination at step S140, if the total driving time of the magnetron 20 is beyond the cooking time (TS), the control unit 120 supplies a control signal to the magnetron driver 130 to stop the driving of the magnetron 20.

By this, if the supply of the high voltage through the magnetron driver 130 from the high voltage transformer 130 is stopped according to the control signal output from the control unit 120, the magnetron 20 is stopped of its driving. The control unit 120 then outputs a control signal to stop driving the turntable 50 and the fan 70, step S160.

Successively, rotation of the turntable 50 is stopped by the turntable motor 50 and the fan 70 is also stopped in rotation.

Successively, the control unit 120 outputs a control signal to generate a cooking completion sound, step S170, and a cooking completion sound is generated from the signal sound generating unit 160 according to the control signal output from the control unit 120.

Figure 5:
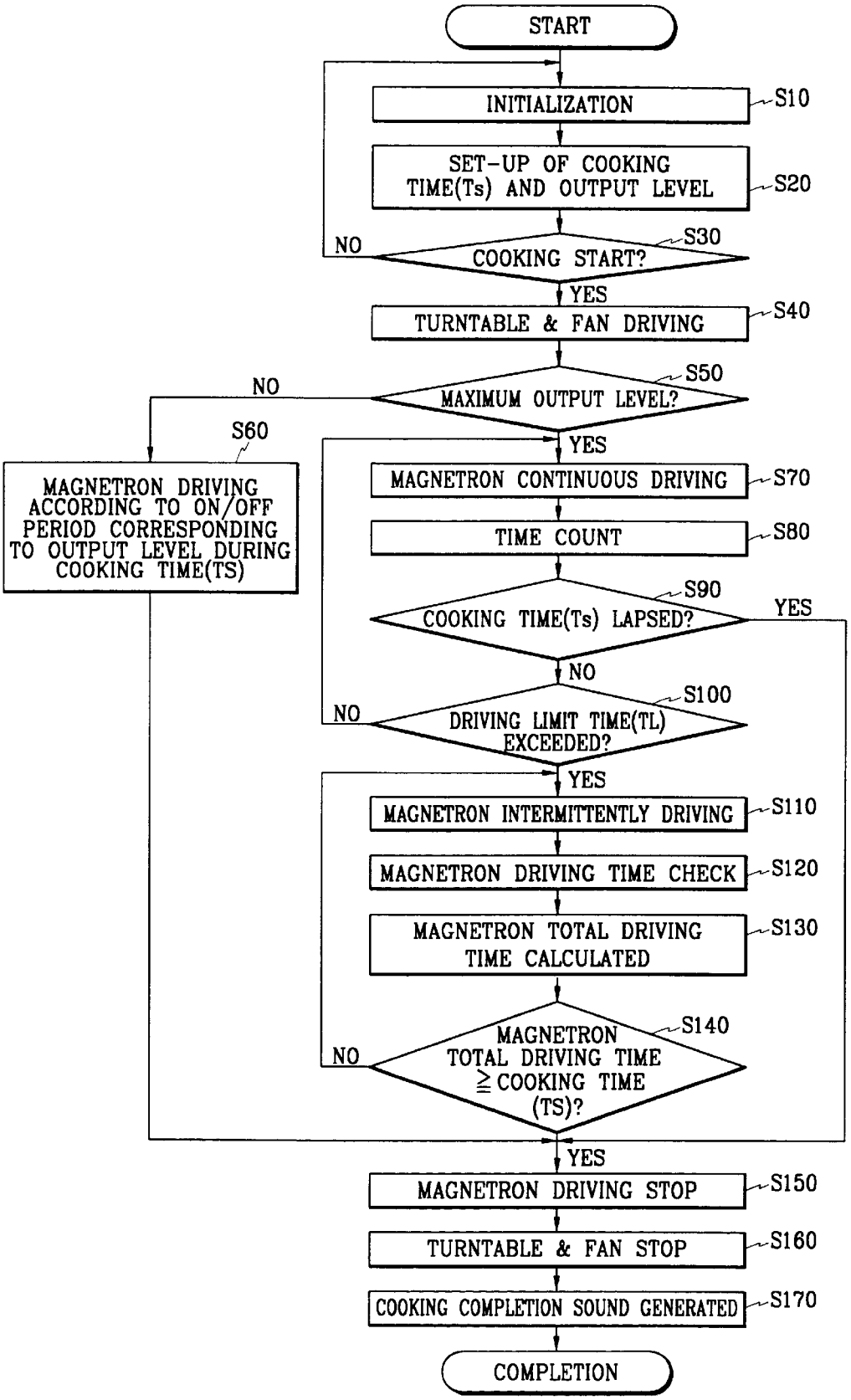
FIG. 5 is a flow chart for illustrating a control operation process of a control unit according to the first embodiment of the present invention.
Figure 6A:
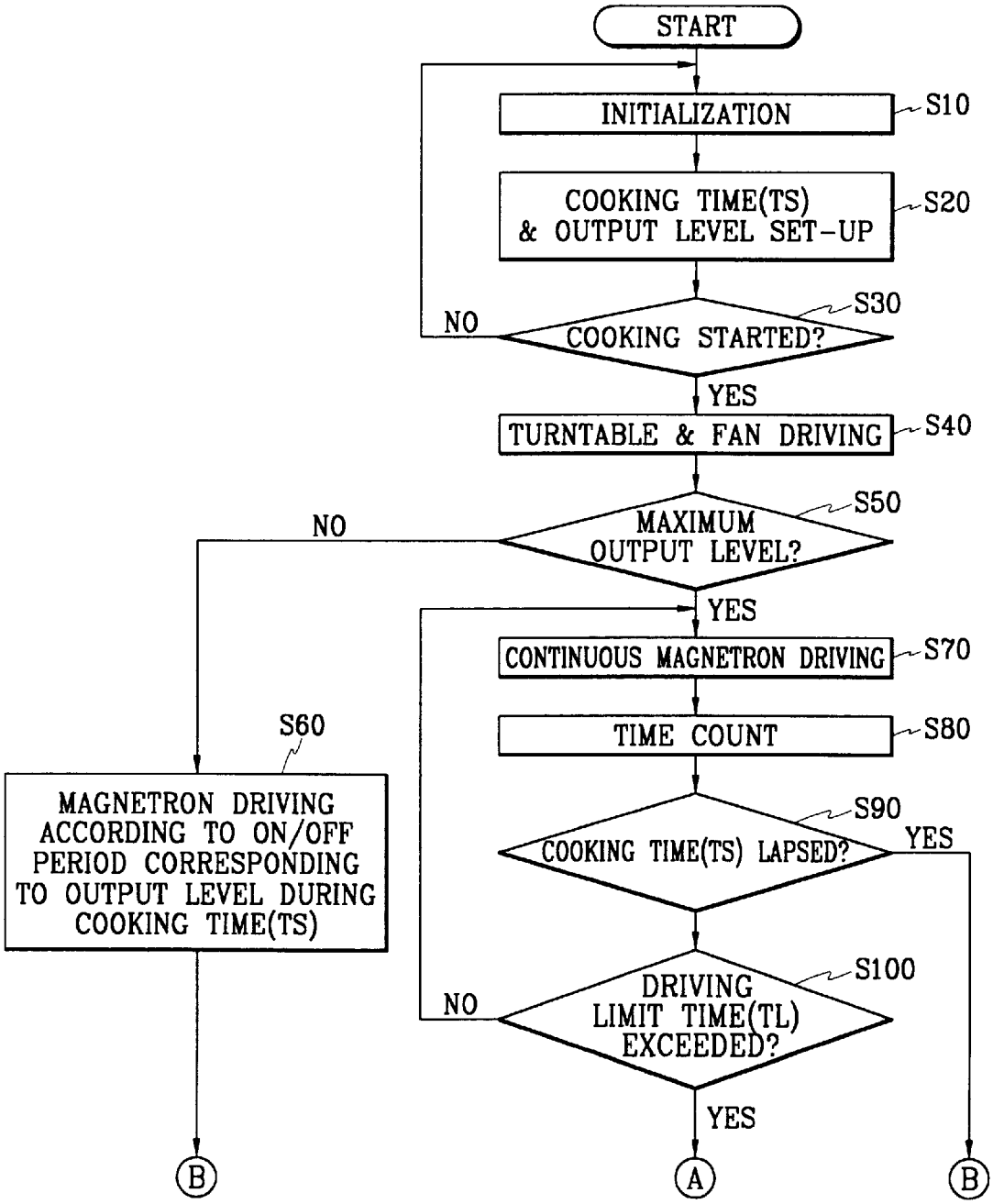
FIG. 6A is a first part of a flow chart for illustrating a control operation process of a control unit according to a second embodiment of the present invention.
Figure 6B:
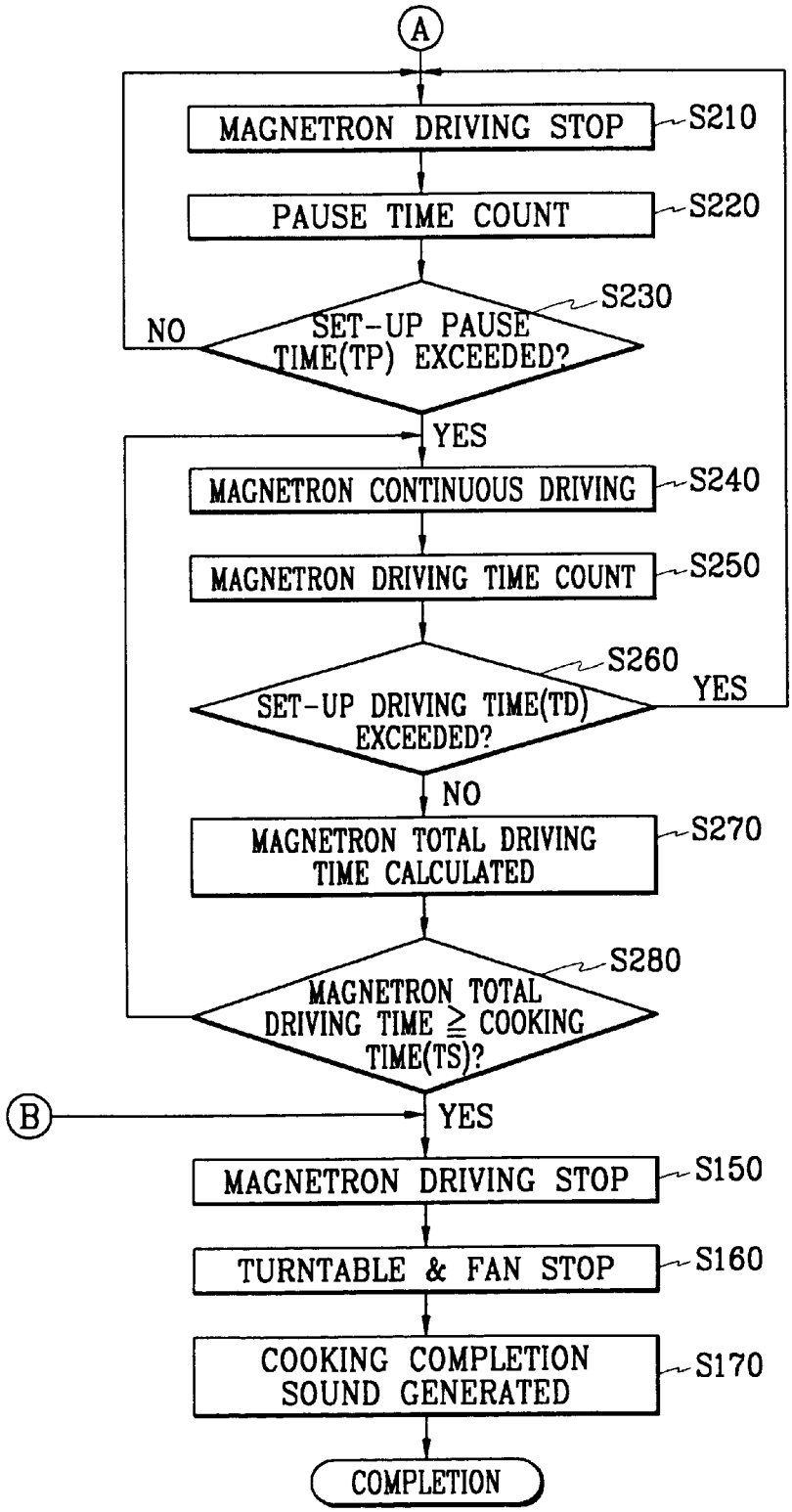
FIG. 6B is a second part of the flow chart.

Now, the second preferred embodiment of the present invention is described in detail with reference to FIGS. 6 and 7, where, throughout the drawings, like reference numerals and symbols as in FIG. 5 are used for designation of like or equivalent parts or portions to avoid redundant description and to simplify illustration.

First of all, as a result of the discrimination at step S100, if the driving time of the magnetron 20 exceeds the pre-established driving limit time (TL), the control unit 120 applies a control signal to the magnetron driver 130 in order to stop driving the magnetron 20, step S210.

The supply of the high voltage is therefore stopped to subsequently cease operation of the magnetron 20. Successively the control unit 120 counts, step S220, a pause time from which the magnetron 20 is stopped in driving at step S210, and discriminates, step S230, whether the counted pause time of the magnetron 20 has exceeded a pre-established pause time (TP; by way of example, approximately 5 minutes).

As a result of the discrimination at step S230, if the pause time of the magnetron 20 is within the pre-established pause time (TP), flow returns to step S210 to keep a driving pause state of the magnetron 20.

At this time, the heat of high temperature generated from the high voltage transformer 10 becomes cooled by natural convection of ambient air during the pause time (TP) of the magnetron 20 at which time the magnetron 20 is not driven to prevent the current from flowing from the high voltage transformer 10, and that the heat of high temperature from the high voltage transformer 10 exceeding a rated temperature is avoided.

In other words, when the continuous driving time of the magnetron 20 exceeds the pre-established driving limit time (TL), the magnetron 20 is stopped in driving to thereby provide a sufficient time during which the high voltage transformer 10 can be cooled down by itself.

As a result of the discrimination at step S140, if the counted pause time of the magnetron 20 exceeds the pre-established pause time (TP), the control unit 120 supplies a control signal to the magnetron driver 130 to continuously drive the magnetron 20, step S240.

By this, the high voltage is continuously supplied to the magnetron 20 via the magnetron driver 130, and successively the microwaves are continuously generated from the magnetron 20 to be supplied into the cooking chamber 40 via the waveguide. The foodstuff on the turntable 50 in the cooking chamber 40 is then cooked by the dielectric heating operation.

Now, the control unit 120 counts the driving time of the magnetron 20 from a point the magnetron 20 has been driven, step S250, and discriminates whether the driving time of the magnetron 20 counted at the step S240 has exceeded an established driving time (TD; by way of example, approximately 20 minutes), step S260.

As a result of the discrimination at step S260, if the driving time of the magnetron 20 counted at step S240 exceeds the established driving time (TD), flow returns to step S240 to stop driving the magnetron 20 during the pre-established pause time (TP).

By way of reference, it is preferable to establish the established driving time (TD) at a shorter time than the driving limit time (TL) because it is difficult for the temperature of the high voltage transformer 10 to go down to a temperature prior to the initial driving status of the magnetron 20, even though the heat of high temperature of the high voltage transformer 10 becomes cooled by way of natural convection. By way of example, in case a driving limit time (TL1) has been established at an approximately 30 minutes, it is preferable to set up the established driving time (TD) at approximately 20 minutes.

As a result of the discrimination at step S260, if the driving time of the magnetron 20 counted at step S240 is within the established driving time (TD), the control unit 120, a total driving time of the magnetron 20 is counted excepting the pause time (TP) from the driving time at step S70 of the magnetron 20, step S270.

Successively, the control unit 120 compares the total driving time of the magnetron 20 calculated at step S270 with the cooking time (TS) selectively input via the key input unit 110, step S280, and as a result of the comparison, if the total driving time is less than the cooking time (TS) flow returns to step S240, where repeated procedures are performed that the magnetron 20 is continuously driven during the established driving time (TD) while the magnetron 20 is stopped in driving during the pause time (TP).

As a result of the discrimination at step S280, if the total driving time is beyond the cooking time (TS), flow proceeds to the step S150 where the magnetron 20 is stopped in driving, thereby completing the cooking operation.

Figure 7:
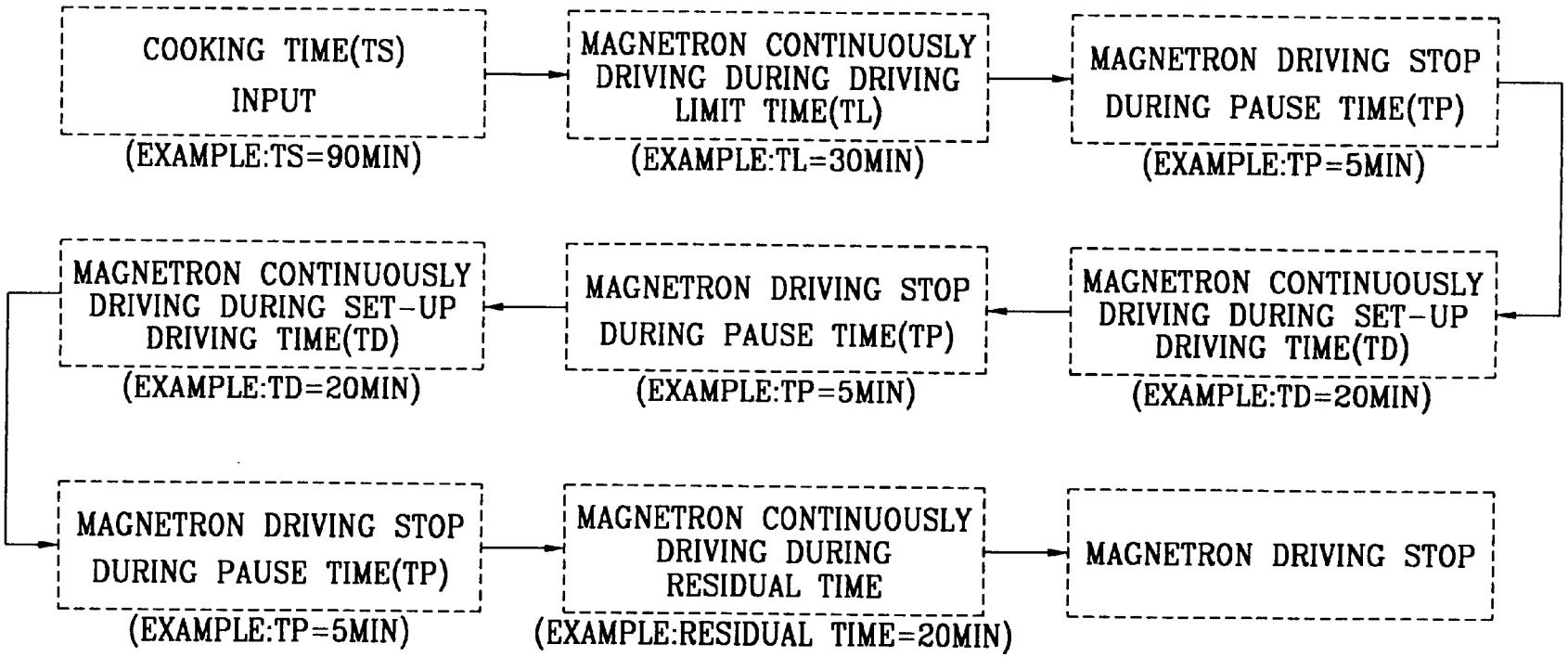
FIG. 7 is a flow chart for schematically illustrating an example of operation status in a magnetron according to the control operation process illustrated in FIGS. 6A and 6B.

By way of example, under circumstances where the driving limit time (TL) is approximately 30 minutes, the established driving time (TD) is approximately 20 minutes, and pre-established pause time (TP) is approximately 5 minutes, and when an output level of maximum value is selectively input via the key input unit 110 and cooking time (TS) of approximately 90 minutes is selectively input, the magnetron 20 is operated as per FIG. 7.

As apparent from the foregoing, there is an advantage in the magnetron driving control apparatus of a microwave oven and method thereof by which a magnetron is continuously driven when an output level selectively input by a user belongs to a continuous driving output range, and when the output level exceeds an established time, the magnetron is intermittently driven according to a predetermined period to allow a high voltage transformer to cool by itself during the period the driving of the magnetron is stopped, thereby preventing the high voltage transformer from becoming over-heated and avoiding the high voltage transformer from becoming larger in size to decrease a heat generated by an electric resistance.

There is another advantage in that there is no need to use a large sized high voltage transformer having an enlarged coil diameter and a core, thereby decreasing a manufacturing cost and overall weight of the product.

What is claimed is:

1. A magnetron driving control apparatus of a microwave oven for applying a high voltage generated from a high voltage transformer according to a cooking time and a power output level selectively input by a user to thereby drive a magnetron, the apparatus comprising:

determining means for determining whether the selected output level involves a continuous driving mode of the magnetron;

counting means for counting a continuous driving time of the magnetron; and control means for supplying a control signal for driving the magnetron if the determining means determines that the selected output level involves the continuous driving mode, for determining whether a counted continuous driving time of the magnetron exceeds a pre-established driving limit time, and for supplying a control signal to intermittently drive the magnetron if the continuous driving time of the magnetron exceeds the pre-established driving limit time.

2. A microwave oven for applying a high voltage generated from a high voltage transformer according to a cooking time and a power output level selectively input by a user to thereby drive a magnetron, the microwave oven comprising:

determining means for determining whether the selected output level involves a continuous driving mode of the magnetron;

counting means for counting a continuous driving time of the magnetron; and control means for supplying a control signal for driving the magnetron if the determining means determines that the selected output level involves the continuous driving mode, for determining whether a counted continuous driving time of the magnetron counted exceeds a pre-established driving limit time, and for supplying a control signal to intermittently drive the magnetron if the continuous driving time of the magnetron exceeds the pre-established driving limit time.

3. A magnetron driving control method of a microwave oven for applying a high voltage generated from a high voltage transformer according to a cooking time and a power output level selectively input by a user to thereby drive a magnetron, the method comprising the steps of:

A) determining whether the selected output level involves a continuous driving mode of the magnetron;

B) continuously driving the magnetron if it is determined in step A that the continuous driving mode is involved;

C) counting a continuous driving time of the magnetron in step B;

D) determining whether a continuous driving time of the magnetron counted in the step C exceeds a pre-established driving limit time; and E) intermittently driving the magnetron if the continuous driving time of the magnetron counted in step D exceeds the pre-established driving limit time.

4. The method as defined in claim 3, further including following step E, the step of:

stopping the drive of the magnetron when an overall driving time comprising a sum of the continuous driving time of step B and the intermittent driving times of step E exceeds a cooking time selectively input by a user.

5. A magnetron driving control method of a microwave oven for applying a high voltage generated from a high voltage transformer according to a cooking time selectively input by a user and a power output level selectively input by a user to thereby drive a magnetron, the method comprising the steps of:

A) determining whether the selected output level involves a continuous driving mode of the magnetron;

B) continuously driving the magnetron if it is determined in step A that the continuous driving mode is involved;

C) counting the continuous driving time of the magnetron occurring in step B;

D) determining whether a continuous driving time counted in step C exceeds a first pre-established driving limit time;

E) pausing the drive of the magnetron when the first continuous driving time of the magnetron counted in step C exceeds the first pre-established continuous driving limit time;

F) counting the pause time of the magnetron;

G) determining whether the pause time of the magnetron counted in step F has exceeded a pre-established pause time;

H) continuously driving the magnetron when the pause time of the magnetron counted in step F exceeds the pre-established pause time;

I) counting the continuous driving time of the magnetron occurring in step H;

J) determining whether the continuous driving time of the magnetron counted in step I has exceeded a second pre-established driving time;

K) returning to step E for pausing the drive of the magnetron when the continuous driving time of step H counted in step I exceeds the second pre-established driving time; and L) stopping the drive of the magnetron when the total counted driving time of the magnetron exceeds the cooking time selectively input by the user.

* * * * *